US007140914B2

(12) United States Patent
Kojima

(10) Patent No.: US 7,140,914 B2
(45) Date of Patent: Nov. 28, 2006

(54) CONNECTOR, CABLE WITH THE SAME, AND PRODUCING METHOD OF THE CABLE

(75) Inventor: Nobuaki Kojima, Mie (JP)

(73) Assignees: Autonetworks Technologies, Ltd., Mie (JP); Sumitomo Wiring Systems, Ltd., Mie (JP); Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 11/147,292

(22) Filed: Jun. 8, 2005

(65) Prior Publication Data

US 2005/0287875 A1 Dec. 29, 2005

(30) Foreign Application Priority Data

Jun. 9, 2004 (JP) ..... 2004-170709

(51) Int. Cl.
*H01R 9/05* (2006.01)

(52) U.S. Cl. ..... 439/585

(58) Field of Classification Search ..... 439/585, 439/877

See application file for complete search history.

(56) References Cited

U.S. PATENT DOCUMENTS 3,648,224 A * 3/1972 McDonough ..... 439/585
3,660,805 A * 5/1972 McDonough ..... 439/585
3,670,293 A * 6/1972 Garver ..... 439/585
3,699,504 A * 10/1972 Huber ..... 439/585
3,857,995 A * 12/1974 Wyrick ..... 174/84 C
4,010,538 A * 3/1977 O'Keefe et al. ..... 29/865
4,031,614 A * 6/1977 Gipe ..... 29/879
5,145,409 A * 9/1992 Sato et al. ..... 439/585
5,302,146 A * 4/1994 Yamamoto ..... 439/877
5,549,483 A * 8/1996 Hotea ..... 439/399
5,997,335 A * 12/1999 Kameyama et al. ..... 439/394
6,045,417 A * 4/2000 Igel ..... 439/877
6,083,034 A * 7/2000 Kameyama ..... 439/394
6,101,712 A * 8/2000 Wright ..... 29/863
6,200,162 B1 * 3/2001 Aoyama et al. ..... 439/578
6,210,223 B1 * 4/2001 Aoyama et al. ..... 439/585
6,217,379 B1 * 4/2001 D'Hulster et al. ..... 439/752.5
6,287,157 B1 * 9/2001 Suzuki et al. ..... 439/851
6,384,335 B1 * 5/2002 Saito et al. ..... 174/74 R
6,706,290 B1 * 3/2004 Kajander et al. ..... 424/616
6,808,417 B1 * 10/2004 Yoshida ..... 439/585

FOREIGN PATENT DOCUMENTS

JP A 2001-185302 7/2001

* cited by examiner

*Primary Examiner*—Gary F. Paumen
*Assistant Examiner*—Larisa Tsukerman
(74) *Attorney, Agent, or Firm*—Oliff & Berridge, PLC

(57) ABSTRACT

In a connector which is loaded to the end of a cable including an internal conductor and an external conductor arranged radially outside of the internal conductor via an insulation layer therebetween. The internal conductor covering part has a covering piece capable of being bent inside. The covering piece is formed between an electric connection part of the external conductor terminal and the external conductor crimping part. A covering insulation member is formed by an electric insulator. The covering insulation member covers an inner side surface of the internal conductor covering part. The covering piece of the internal conductor covering part and the covering insulation member are integrally bending inside. The covering piece of the internal conductor covering part and the covering insulation member have a shape to cover the internal conductor covering part from outside.

12 Claims, 9 Drawing Sheets

CONNECTOR, CABLE WITH THE SAME, AND PRODUCING METHOD OF THE CABLE

BACKGROUND OF THE INVENTION

1. Field of the Invention

The present invention relates to technology of a connector connected to the end of a co-axial cable and a shield cable.

2. Description of the Related Art

Of conventional cables, there are some cables which are equipped with both an internal conductor and an external conductor, for example, a co-axial cable and a shield cable. Connectors to be connected to the end of such cable are those equipped with an internal conductor terminal and an external conductor terminal connected respectively to the end of the internal conductor and that of the external conductor and in which a terminal insulation member comprising an electric insulator lies between the electric connection parts of these terminals.

One example is shown in FIG. 9.

An illustrated cable 10 is provided with an internal conductor 12 and, for example, a braided external conductor 16, in which an insulation layer 14 lies between both conductors 12 and 16 and an exterior of the external conductor 16 is covered with a sheath 18.

On the other hand, a connector connected to the cable 10 is provided with an internal conductor terminal 100, external conductor terminal 110 and terminal insulation member 120.

The internal conductor terminal 100 is provided with an electric connection part 102 fitted into an opposing internal conductor terminal and an internal conductor barrel 104 crimped to the end in such a manner that embraces the end of the internal conductor 12. The external conductor terminal 110 is provided with an electric connection part 112 fitted into an opposing external conductor terminal, an external conductor barrel 114 crimped to the end in such a manner that embraces the end of the external conductor 16 and an insulation barrel 116 crimped to the end in such a manner that embraces the end of the sheath 18. The terminal insulation member 120 is a cylindrical form lying between the electric connection part 102 of the internal conductor terminal 100 and the electric connection part 112 of the external conductor terminal 110, and the internal conductor barrel 104 is provided immediately therebehind.

Incidentally, the thus structured connector is necessary to match the impedance of the connector to that of the cable 10 as much as possible, particularly in sending high-frequency wave electric signals, and insufficiency of such matching will cause a great reflection of the signals and result in disadvantage of a significant decrease in transmission efficiency of the signals. In this instance, an part where electric connection parts 102 and 112 of the connector are overlapped is relatively large in the sectional area, and a terminal insulation member 120 higher in dielectric constant than air lies between the electric connection parts 102 and 112, thereby making it easy to reduce the impedance accordingly and match the impedance with that of the cable 10. In contrast, a part where the internal conductor barrel 104 is crimped to the internal conductor 12 immediately therebehind (hereinafter referred to as "internal conductor crimping part") is small in the sectional part and the internal conductor barrel 104 is in a condition which is opened outside and surrounded with air, thereby keeping the impedance high and making it difficult to match the impedance with that of the cable 10. Therefore, it is a serious problem in adjusting the impedance at the internal conductor crimping part.

As a means to solve such a problem, JP-A-2001-185302 shown below has disclosed a method in which while an internal conductor crimping part is inserted into a heat-shrinkable tube having an electrically conductive layer inside, the tube is subjected to heat shrinkage and the electrically conductive layer of the tube is closely attached to the internal conductor crimping part, by which the internal conductor crimping part is covered with the tube.

SUMMARY OF THE INVENTION

JP-A-2001-185302 requires an operation for accurately positioning a heat-shrinkable tube to an internal conductor crimping part and an operation for heating the heat-shrinkable tube, with such a positioning being kept. These operations are not necessarily easy. Further, an excessively great shrinkage of the heat-shrinkable tube may result in an excessive contact pressure of an electrically conductive layer with the internal conductor crimping part, whereas insufficiency of the shrinkage may result in removal of the heat-shrinkable tube from the internal conductor crimping part. Therefore, it is difficult to control the shrinkage.

There is another method in which the internal conductor crimping part is wrapped with a metal tape so as to increase the sectional area of the conductor at this part. However, it is practically difficult to stably obtain a desired sectional area by wrapping with the metal tape. Further, the metal tape may act as an intermediate to cause short-circuiting between an internal conductor and an external conductor.

In addition, considered is an idea that a terminal insulation member 120 shown in FIG. 9 is extended in axial length so that not only the electric connection part 102 of the internal conductor terminal 100 but also the internal conductor crimping part can be inserted into the terminal insulation member 120 (namely, the terminal insulation member 120 exists also outside the internal conductor crimping part). However, the internal conductor 120 of the cable 10 and the insulation layer 14 may be easily buckled on such insertion, resulting in a poor workability, which is disadvantageous. Further, where a larger clearance is provided between the terminal insulation member 120 and the internal conductor crimping part in order to make the operation easier, an air layer is increased and results in elevation of the impedance.

It is an object of the present invention to provide a connector or cable with the connection which make it possible to easily and appropriately adjust the impedance at the crimping part of the internal conductor of the cable and the internal conductor terminal by using a simply-structured device.

According to one aspect of the invention, there is provided with a connector which is loaded to the end of a cable including an internal conductor and an external conductor arranged radially outside of the internal conductor via an insulation layer therebetween, the connector including: an internal conductor terminal having: an electric connection part contacting with an opposing terminal; and an internal conductor crimping part being arranged behind the electric connection part, and the internal conductor crimping part being crimped to an end of the internal conductor; an external conductor terminal having: an electric connection part having a shape to cover the electric connection part of the internal conductor terminal outside in a radial direction thereof, and the electric connection part of the external conductor terminal contacting with the opposing terminal; and an external conductor crimping part being arranged behind the electric connection part of the external conductor terminal, and the external conductor crimping part being crimped to an end of the external conductor; a terminal insulation member being formed by an electric insulator and being disposed between the electric connection part of the internal conductor terminal and the electric connection part of the external conductor terminal, an internal conductor covering part having an covering piece capable of being bent inside, the covering piece being formed between the electric connection part of the external conductor terminal and the external conductor crimping part, a covering insulation member being formed by an electric insulator and covering an inner side surface of the internal conductor covering part. The internal conductor covering part is at least partially covered from outside by integrally bending at least one of the covering piece of the internal conductor covering part and the covering insulation member inside.

By thus configuration, for example, the internal conductor crimping part of the internal conductor terminal and the external conductor crimping part of the external conductor terminal are crimped respectively to the internal conductor and the external conductor of the cable to fabricate the terminal, terminal insulation member and covering insulation member, and an covering piece of the external conductor terminal and an covering insulation member arranged therein are bent inside together so that the covering piece and the insulation member are given such a configuration that covers the internal conductor crimping part from the outside, thereby making it possible to reduce the impedance at the internal conductor crimping part.

In this instance, the covering piece is formed on the external conductor terminal having the external conductor crimping part, it is not necessary to separately perform positioning of operation the covering piece to the internal conductor crimping part, other than positioning operation of the external conductor crimping part to the external conductor and also making it possible to adjust the impedance easily and appropriately by a simple step of bending the covering piece and the covering insulation member after they are set, similar to crimping the external conductor crimping part by pressure. Since a covering insulation member is provided inside the covering piece, short-circuiting between the external conductor terminal and the internal conductor terminal can be avoided and an impedance can also be further reduced.

Further, unlike the heat-shrinkable tube disclosed in JP-A-2001-185302, the covering insulation member is not necessarily required to be closely attached to the internal conductor pressure part, thereby making the operation easier. In addition, by actively forming an air layer between the covering insulation member and the internal conductor crimping part in association with such separation it becomes possible to utilize the thickness of the air layer for adjustment of the impedance.

The covering piece of the external conductor terminal may be available singularly, however, it is more preferably formed both on the right and left sides of the internal conductor crimping part. Such configuration makes it possible to divide the bending amount required for the covering piece into right and left, thus resulting in an easier bending work.

In this instance, if a connection part connecting the right and left covering pieces of the external conductor terminal and a part of the covering insulation member corresponding to the connection part are given an inwardly recessed configuration, the impedance at these parts can be further reduced.

Further, if the covering insulation member is provided with a thin bent part, which is locally made thin for bending, the bent part may be more easily treated and also the impedance can be set by referring to a site where the locally thin part is formed.

The terminal insulation member and the covering insulation member may be formed independently. However, when an insulation member is provided in which a terminal insulation part lying between an electric connection part of the internal conductor terminal and that of the external conductor terminal is formed integrally with an covering insulation part covering the inner plane of the internal conductor covering part, the number of parts can be reduced to more easily assemble the connector.

In this instance, when the insulation member is provided with an inwardly recessed part at an area corresponding to the connection part of the external conductor terminal and the recessed part of the external conductor terminal is from behind brought into contact with a projected part formed between the recessed part and a part anterior to the recessed part, by which the insulation part is constituted so as not to be removed from the external conductor terminal, the insulation member can be locked on the external conductor terminal due to the configuration of the recessed part and such locking is able to prevent the insulation member from removing backward from the external conductor terminal.

According to another aspect of the invention, there is provided with a method for manufacturing a cable with a connector, including: crimping the internal conductor crimping part to an end of the internal conductor of a cable including an internal conductor and an external conductor arranged radially outside of the internal conductor via an insulation layer therebetween; assembling the connector; crimping an external conductor crimping part of an external conductor terminal of the connector to the end of the external conductor of the cable; and bending the covering piece of the external conductor terminal and the covering insulation member arranged therein inside together covering the internal conductor crimping part from the outside by the covering piece and the covering insulation member, thereby to connect the crimping member to the electric connection member.

By thus method, there is no particular restriction on types of cable, and where the cable is a shield cable on which the outer conductor is grounded, the shield performance can also be improved.

According to the above aspects of the invention, the connector or the cable with the connector are simple in structure, are effective in making an easy and appropriate adjustment of the impedance at the crimping part between the internal conductor of the cable and the internal conductor terminal.

DESCRIPTION OF THE PREFERRED EMBODIMENTS

Figure 1:
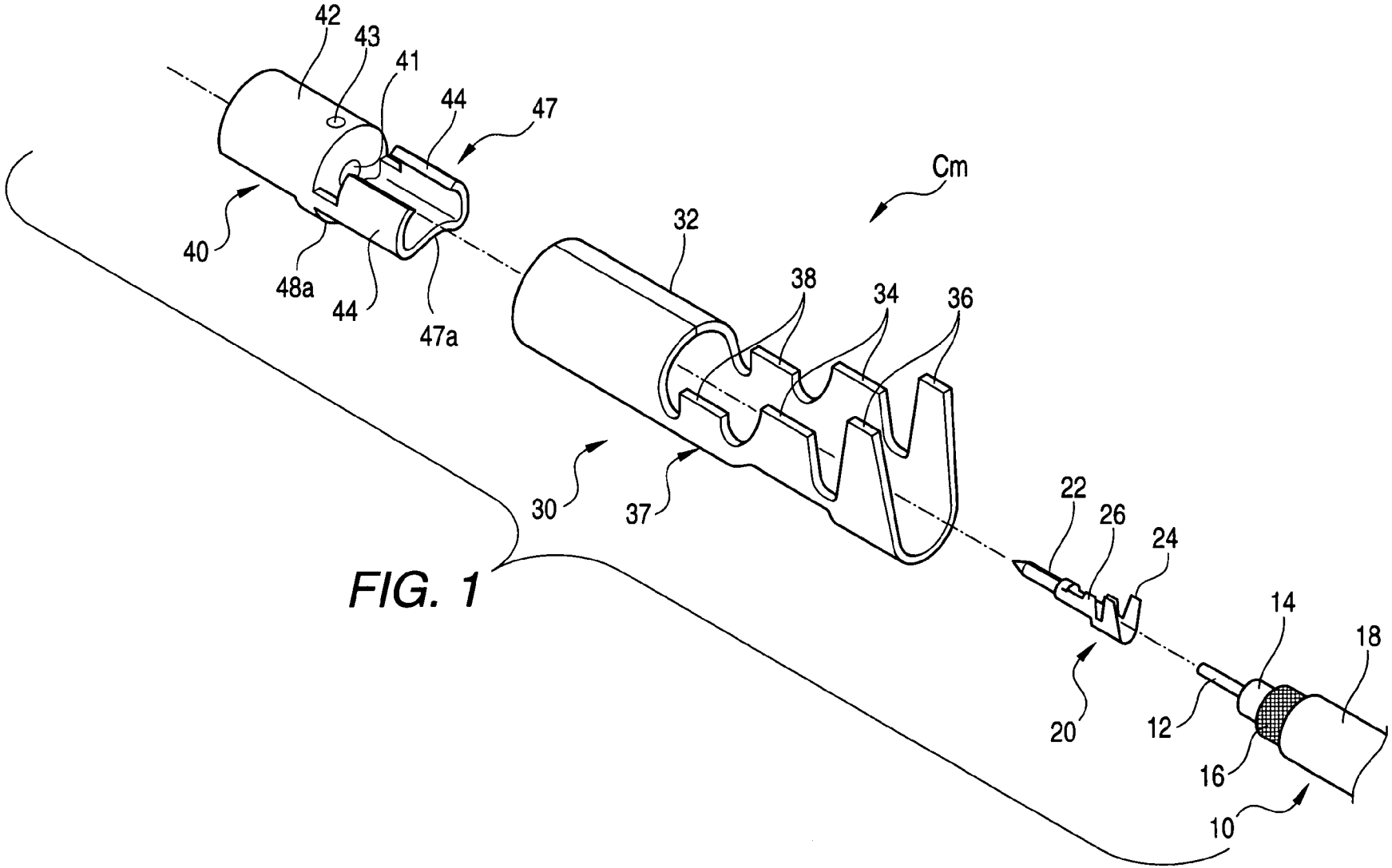
FIG. 1 is an exploded perspective view showing an outline structure of a male connector of the embodiment in the present invention.

An explanation will be made for a preferred embodiment of the present invention by referring to FIG. 1 through FIG. 8. The embodiment discloses a male connector Cm and a female connector Cf which are fittable each other and connected to the end of a cable 10. The cable 10 is provided with an internal conductor 12 and an external conductor 16 arranged via an insulation layer 14 radially outside of the internal conductor, in which the external conductor 16 is externally covered with a sheath 18 and which is applicable either to a co-axial cable or a shield cable.

First, an explanation will be made for the structure of the male connector Cm by referring to FIG. 1 to FIG. 4. The male connector Cm is provided with an internal conductor terminal 20, an external conductor terminal 30 and an insulation member 40.

A male tab 22 is formed at a front end of the internal conductor terminal 20 as an electric connection part, and an internal conductor barrel 24 is formed at the rear end. The internal conductor barrel 24 is constituted with a pair of right and left erect pieces, and bent in such a manner to embrace the internal conductor 12 from right and left, by which it is crimped to the internal conductor 12. Further, a stabilizer 26 for preventing a reverse insertion projects upward at a location between the internal conductor barrel 24 and the tab 22.

The external conductor terminal 30 is provided with an electric connection part 32 at the front end and with an external conductor barrel 34 and insulation barrel 36 therebehind. The electric connection part 32 is in an approximately tubular form, and configured so as to cover from radially outwardly a tab 22 on the internal conductor terminal 20. The external conductor barrel 34 is constituted with a pair of right and left erect pieces and bent so as to embrace an external conductor 16 of the cable 10 from right and left, by which it is crimped to the external conductor 16. Similarly, the insulation barrel 36 is also constituted with a pair of right and left erect pieces and bent so as to embrace a sheath 18 of the cable 10 from right and left, by which it is crimped to the sheath 18.

In addition, the external conductor terminal 30 is characterized in that an internal conductor covering part 37 which covers an internal conductor barrel 24 of the internal conductor terminal 20 is formed between the electric connection part 32 and the external conductor barrel 34. As with the external conductor barrel 34 and the insulation barrel 36, the internal conductor covering part 37 is provided with covering pieces 38, which are a pair of right and left erect pieces, and the covering pieces 38 are bent inside, as with both barrels 34 and 36, thereby making it possible to give such a configuration that the covering pieces 38 cover the internal conductor barrel 24 from above, the details of which will be explained later.

A part connecting a bottom wall 37*a* of the internal conductor covering part 37, namely, these covering pieces 38, is given a configuration which is recessed radially inwardly (upward in the figure). In the figure, the recessed part is formed by giving a so-called hammering finish to the bottom wall 37*a* from the outside.

An insulation member 40 is an integral formation of a terminal insulation part 42 with an insulation part 47 by using an insulating material.

The terminal insulation part 42 is configured so as to lie between the electric connection part 32 of the external conductor terminal 30 and the tab 22 of the internal conductor terminal 20. More concretely, it is given an outer configuration that can be fitted into the electric connection part 32 and provided with an insertion hole 41 through which the tab 22 can be inserted into the axial center. Further, an insertion groove 46 into which the stabilizer 26 of the internal conductor terminal 20 is inserted is formed at an area around the rear end of the insertion hole 41.

The terminal insulation part 42 is provided at the ceiling wall with a through hole 43 provided radially. A piece to be locked 23 of the internal conductor terminal 20 that is shown in FIGS. 2A and 2B is inserted into the through hole 43, by which the internal conductor terminal 20 is to be locked on the insulation member 40.

The covering insulation part 47 is given a configuration that covers an inner plane of the internal conductor covering part 37 at the external conductor terminal 30. To be more specific, it is provided with an insulation covering piece 44 and a bottom wall 47*a* respectively corresponding to the right and left covering pieces 38 of the internal conductor covering part 37 and the bottom wall 37*a*, and the bottom wall 47*a* is given a configuration which is recessed inwardly (upward in the figure). The bottom wall 37*a* of the internal conductor covering part 37 is from behind brought into contact with a projected part 48*a* formed between the bottom wall 47*a* and a part anterior thereto, by which the insulation member 40 is prevented from being removed backward from the external conductor terminal 30.

Figure 2A:
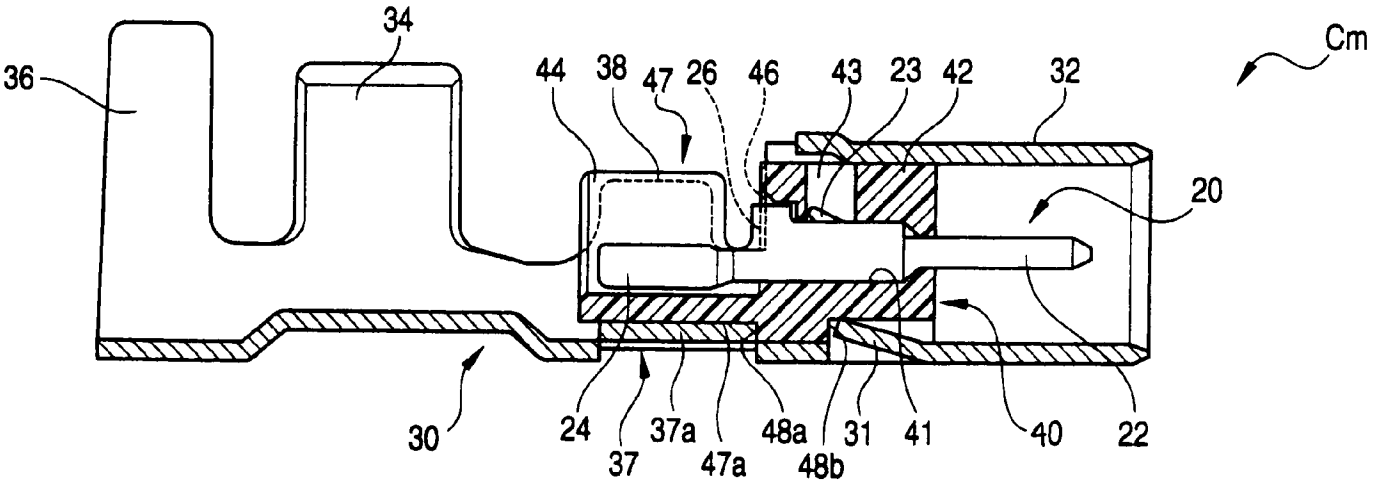
FIG. 2A is a cross side view of a male connector, and 2B is a partial cross side view of the male connector.
Figure 2B:
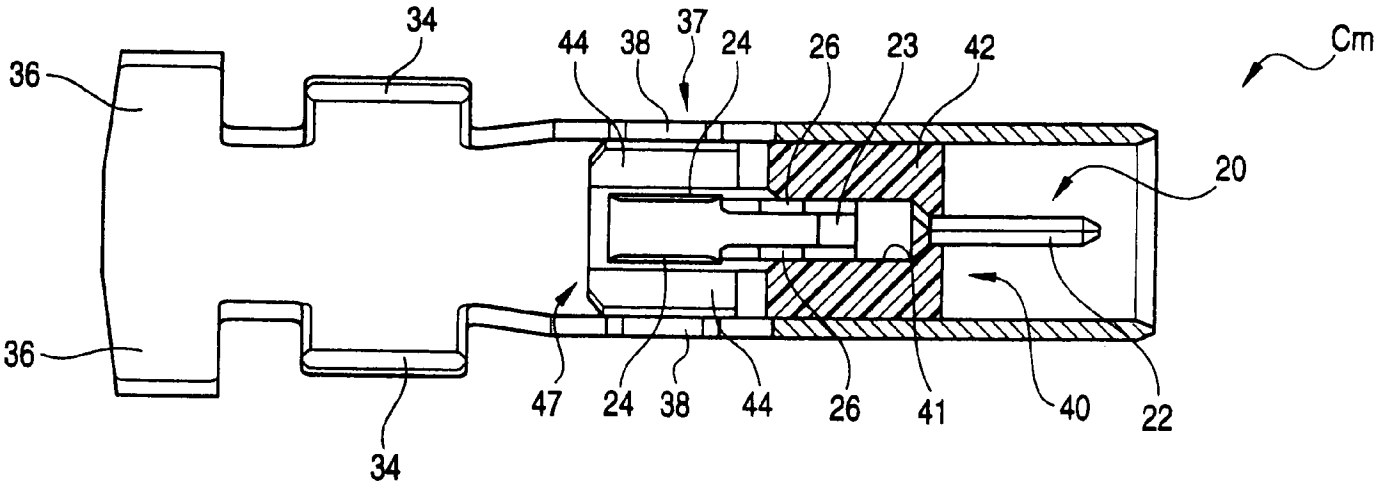
Figure 3B:
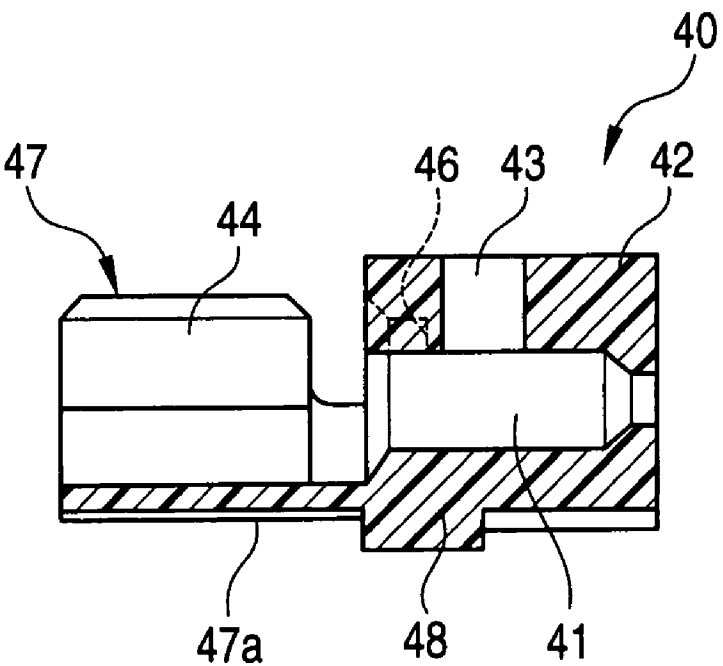
FIG. 3A is a front view of an insulation member built into the male connector, and 3B is a cross side view of the insulation member.
Figure 3A:
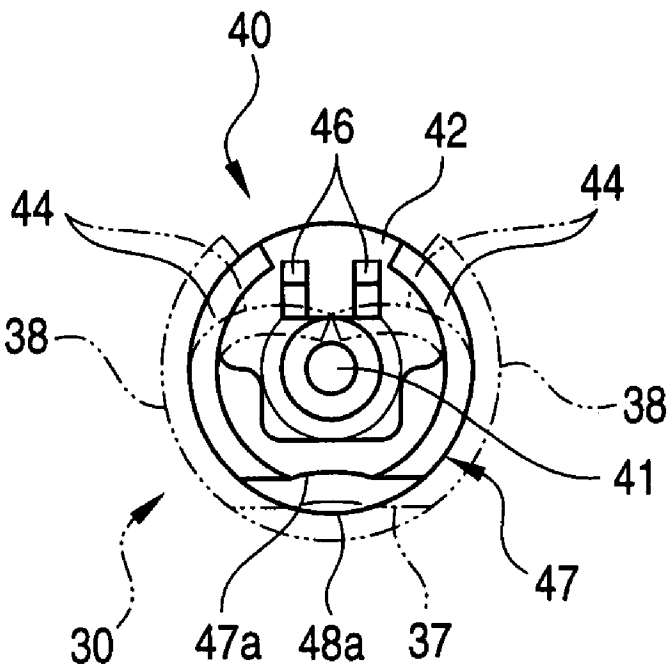

Further, in this embodiment, as shown in FIG. 2A, a projected part 48*b* is also formed at a part anterior to the projected part 48*a*, and a locking piece 31 formed on the external conductor terminal 30 is from the front brought into contact with the projected part 48*b*, by which the insulation member 40 is prevented from being removed forward as well.

Next, an explanation will be made for the structure of a female connector Cf by referring to FIGS. 5A, 5B and FIGS. 6A, 6B. The female connector Cf is provided with an internal conductor terminal 50, an external conductor terminal 60 and an insulation member 70.

The internal conductor terminal 50 is provided at the front end with a female electric connection part 52 into which the tab 22 of the male connector Cm can be fitted and at the rear end with an internal conductor barrel 54. The internal conductor barrel 54 is constituted with a pair of right and left erect pieces and bent so as to embrace the internal conductor 12 from right and left, by which it is crimped to the internal conductor 12. Further, a stabilizer 56 for preventing a reverse insertion projects upward at a location between the internal conductor barrel 54 and the electric connection part 52.

The external conductor terminal 60 is provided at the front end with an electric connection part 62 and at a location therebehind with an external conductor barrel 64 and an insulation barrel 66.

The electric connection part 62 is in an approximately tubular form and configured so as to cover radially outwardly the electric connection part 52 of the internal conductor terminal 50, and the electric connection part 32 of the male connector Cm can be fitted into the electric connection part 62. An electric contact piece 63 which is bent elastically and deformed in association with fitting of the electric connection part 32 is formed on the side wall of an electric connection part 62, and the electric connection part 62 is brought into contact with the outer circumferential wall of the electric connection part 32 by the elastic force, thereby ensuring the conduction between the external conductor terminals 30 and 60.

The external conductor barrel 64 is constituted with a pair of right and left erect pieces and bent so as to embrace the external conductor 16 of the cable 10 from right and left, by which it is crimped to the external conductor 16. Similarly, the insulation barrel 66 is also constituted with a pair of right and left erect pieces and bent so as to embrace a sheath 18 of the cable 10 from right and left, by which it is crimped to the sheath 18.

In addition, the external conductor terminal 60 is characterized in that an internal conductor covering part 67 covering an internal conductor barrel 54 of the internal conductor terminal 50 is formed between the electric connection part 62 and the external conductor barrel 64. As with the external conductor barrel 64 and the insulation barrel 66, the internal conductor covering part 67 is provided with covering pieces 68, which are a pair of right and left erect pieces, and the covering pieces 68 are bent inside, as with the both barrels 64 and 66, thereby making it possible to give such a configuration that the covering pieces 68 cover the internal conductor barrel 54 from above, the details of which will be explained later.

A part connecting a bottom wall 67*a* of the internal conductor covering part 67, namely, the covering pieces 68, is configured so as to be recessed radially inwardly (upward in the figure). For example, as with the bottom wall 37*a* of the external conductor terminal 30, a recessed part can be formed on the bottom wall 67*a* as well by giving a so-called hammering finish.

An insulation member 70 is an integral formation of a terminal insulation part 72 with an insulation part 77 by using an insulating material.

The terminal insulation part 72 is configured so as to lie between the electric connection part 62 of the external conductor terminal 60 and the electric connection part 52 of the internal conductor terminal 50. Concretely, it is given an outer configuration that can be fitted into the electric connection part 62, available in a tubular form which permits the electric connection part 52 to fit into the axial center, and provided at the front tip with a tab insertion hole 71 for accommodating the tab 22 of the male connector Cm. Further, an insertion groove 76 into which a stabilizer 56 of the internal conductor terminal 50 is inserted is formed at the rear end of the electric connection part 62.

The terminal insulation part 72 is provided at the ceiling wall with a through hole 73 provided radially. A piece to be locked 53 of the internal conductor terminal 50 that is shown in FIGS. 2A and 2B is inserted into the through hole 73, by which the internal conductor terminal 50 is locked on the insulation member 70 side.

Figure 5A:
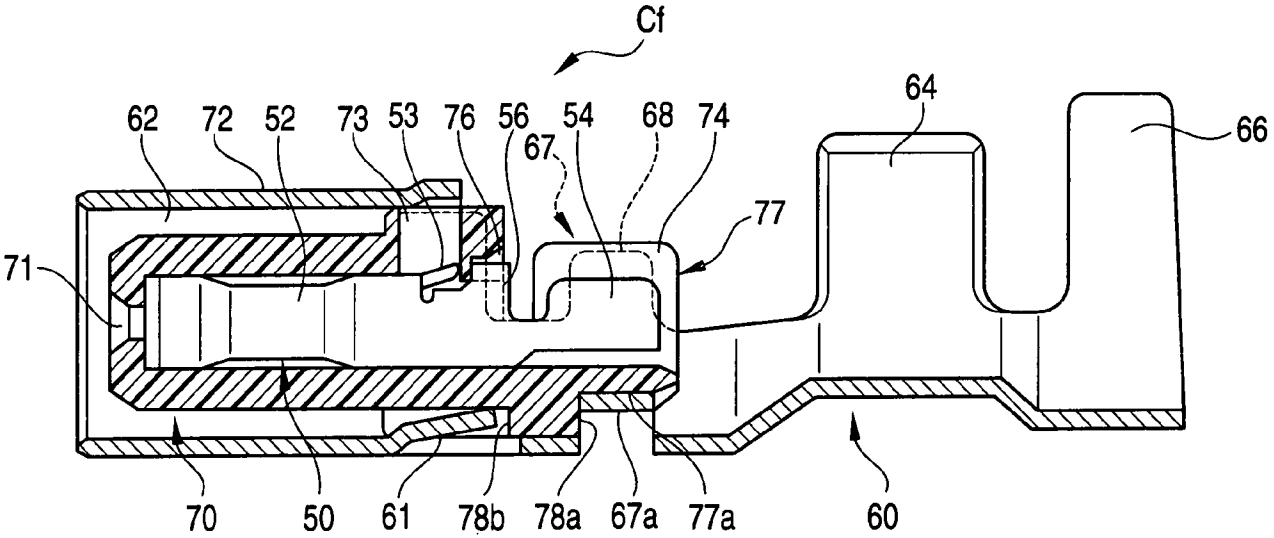
FIG. 5A is a cross side view of a female connector joined to the male connector, and 5B is a fragmentary cross plane view of the female connector.
Figure 5B:
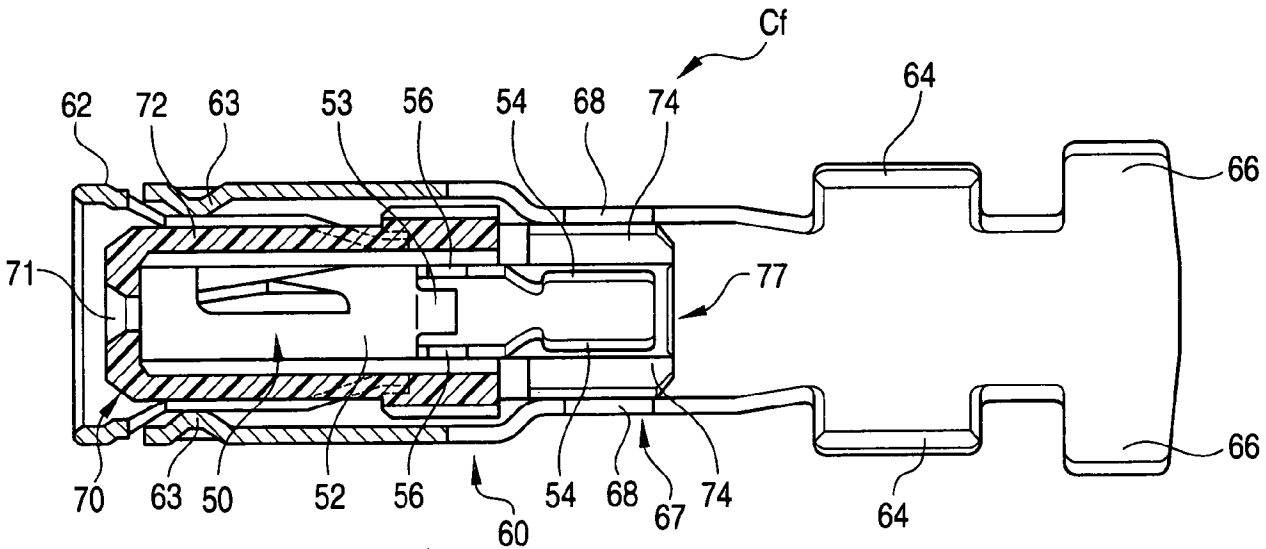

The covering insulation part 77 is configured so as to cover an inner plane of the internal conductor covering part 67 at the external conductor terminal 60. To be more specific, it is provided with an insulation covering piece 74 and a bottom wall 77*a* respectively corresponding to the right and left covering pieces 68 of the internal conductor covering part 67 and the bottom wall 77*a*, and the bottom wall 77*a* is configured so as to be recessed inwardly (upward in the figure). The bottom wall 67*a* of the internal conductor covering part 67 is from behind brought into contact with an projected part 78*a* formed between the bottom wall 77*a* and a part anterior thereto, by which the insulation member 70 is prevented from being removed backward from the external conductor terminal 60. Further, as shown in FIG. 5A, a projected part 78*b* is also formed at a part anterior to the projected part 78*a*, and a locking piece 61 formed on the external conductor terminal 60 is from the front brought into contact with the projected part 78*b*, by which the insulation member 70 is prevented from being removed forward as well.

Figure 6B:
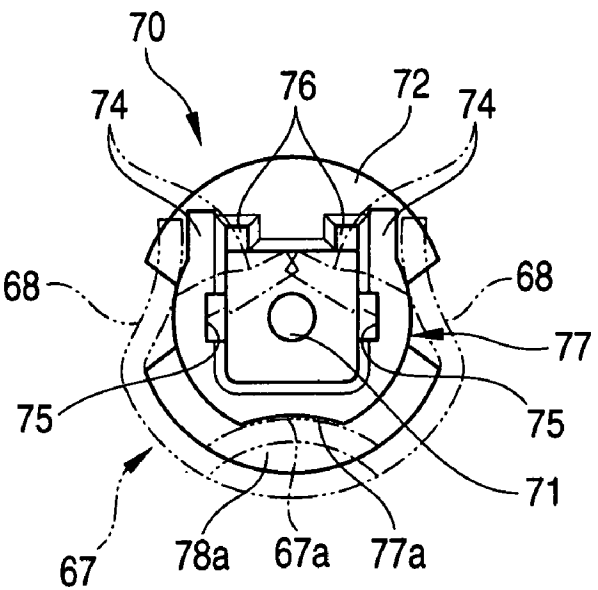
FIG. 6B is a front view of the insulation member.
Figure 6A:
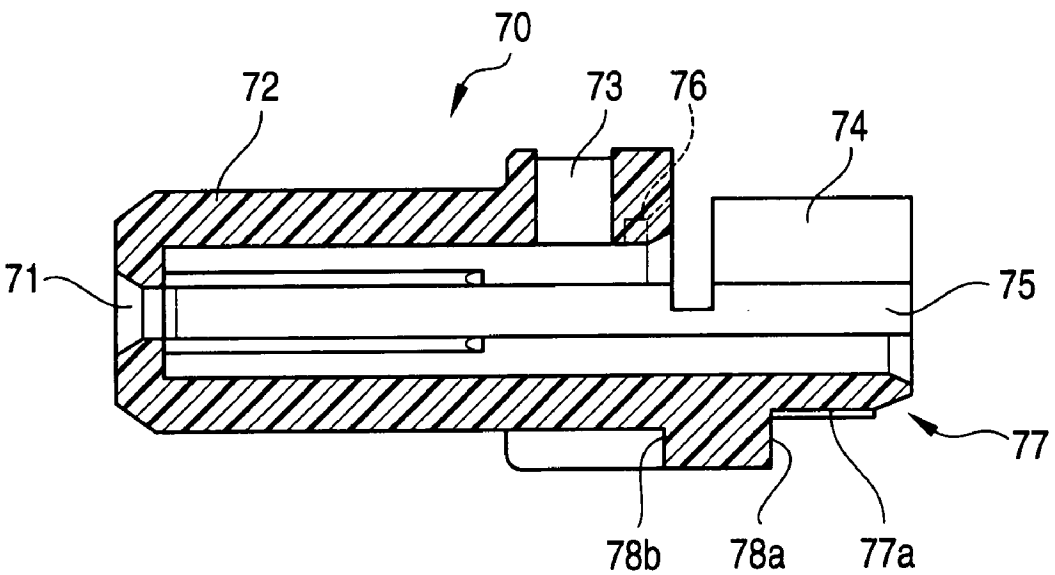
FIG. 6A is a cross sectional view of an insulation member built into the female connector.

In addition, in this embodiment, as shown in FIGS. 6A and 6B, a horizontal groove 75 is formed on the inner plane of the intermediate part at the individual insulation covering pieces 74, which is to be used as a bent part made locally thin. It is, therefore, possible to bend these insulation covering pieces 74 inside easily at the part.

There is no particular restriction on materials of the insulation member 40 or 70, and those with a relatively high dielectric constant, for example, polybutylene terephthalate or those with a relatively low dielectric constant, for example, polymethyl pentane, may be used. In either case, it is more preferable to optimize an outer diameter of the internal conductor terminal and an inner diameter of the external conductor terminal so as to obtain desired impedance properties, with the dielectric constant taken into account.

Next, an explanation will be made for an example of a method for connecting the connectors Cm and Cf with the end of the cable 10, namely, a method for manufacturing a connector-equipped cable.

1) Internal conductor crimping step: In the male connector Cm, the end of the internal conductor 12 of the cable 10 is set inside an internal conductor barrel 24 of the internal conductor terminal 20, the internal conductor barrel 24 is bent inside, with this state being kept, by which the internal conductor barrel 24 is configured so as to embrace the internal conductor 12 from right and left. To be specific, the internal conductor barrel 24 is crimped to the end of the internal conductor 12. Similarly, in the female connector Cf, an internal conductor barrel 54 of an internal conductor terminal 50 is crimped to the end of the internal conductor 12.

2) Assembly step: The connectors Cm and Cf are assembled. In the male connector Cm, the terminal insulation part 42 of the insulation member 40 is fitted into the electric connection part 32 of the external conductor terminal 30, and the tab 22 and the stabilizer 26 of the internal conductor terminal 20 are inserted into the insertion hole 41 and the insertion groove 46 of the terminal insulation part 42. Similarly, in the female connector Cf, the terminal insulation part 72 of the insulation member 70 is fitted into the electric connection part 62 of the external conductor terminal 60, then, the electric connection part 52 of the internal conductor terminal 50 is inserted into the terminal insulation part 72, and the stabilizer 56 is inserted into the insertion groove 76. After completion of this assembly, internal conductor barrels 24 (54) of the internal conductor terminal 20 (50), the end of the external conductor 16 of the cable 10 and the end of a sheath 18 are positioned to the locations respectively corresponding to internal conductor covering parts 37 (67) of external conductor terminals 30 (60), external conductor barrels 34 (64) and insulation barrels 36 (66), and covering insulation parts 47 (77) of insulation members 40 (70) are positioned inside the internal conductor covering parts 37 (67).

A step in which the terminal insulation parts 42 and 72 are inserted into the electric connection parts 32 and 62 of the external conductor terminals 30 and 60 may be done before or after a step in which the internal conductor terminal is crimped. However, in view of supplying parts, it is more preferable to complete at first a step of inserting the terminal insulation parts 42 and 72 and then a step of assembling the external conductor terminal, followed by a step of crimping the internal conductor terminal.

3) External conductor crimping step and sheath crimping step: In the male connector Cm, the external conductor barrel 34 and the insulation barrel 36 of the external conductor terminal 30 are bent inside, by which the barrels 34 and 36 are configured so as to embrace respectively the end of the external conductor 16 and that of the sheath 18 from right and left. To be specific, these barrels 34 and 36 are respectively crimped to the end of the external conductor 16 and that of the sheath 18. Similarly, in the female connector Cf, the external conductor barrel 64 and the insulation barrel 66 of the external conductor terminal 60 are respectively bent inside and crimped to the external conductor 16 and the sheath 18 of the cable 10.

This step may be conducted at the same time with the subsequent covering step, or may be conducted after the covering step.

Figure 4A:
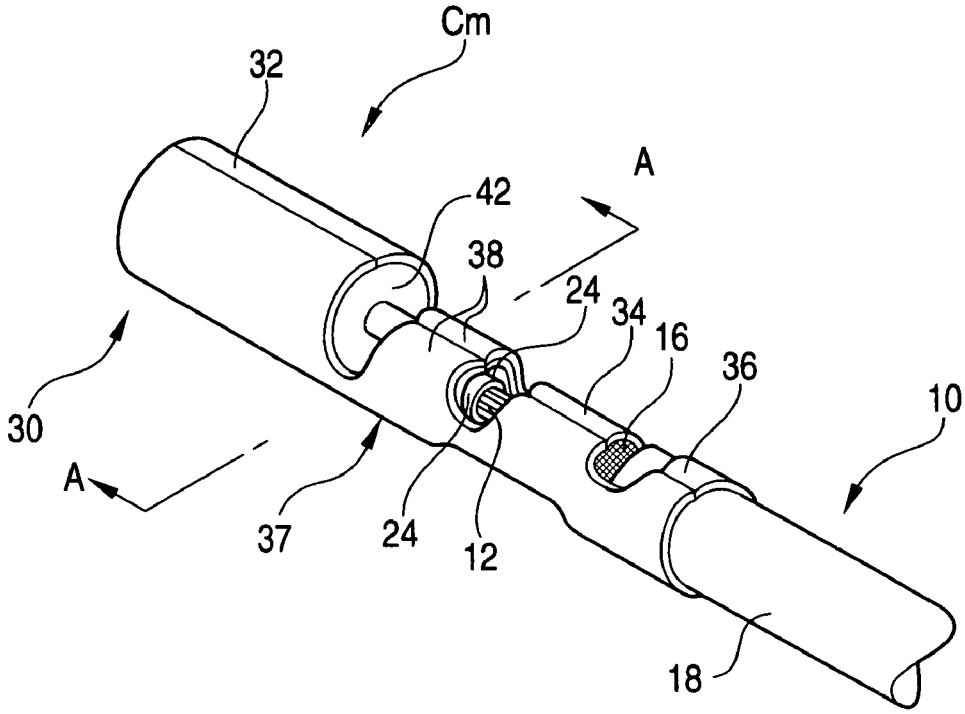
FIG. 4A is a perspective view of the male connector in an integrated state, and 4B is a cross sectional view of 4A taken along line A—A.
Figure 4B:
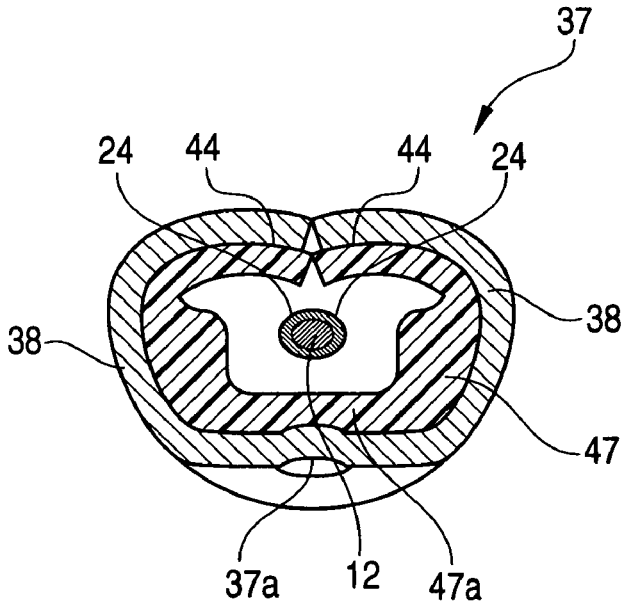

4) Covering step: In the male connector Cm, the covering piece 38 of the internal conductor covering part 37 at the external conductor terminal 30 and the insulation covering piece 44 of the covering insulation part 47 arranged therein are bent inside integrally, by which, as shown in FIGS. 4A and 4B, the covering piece 38 and the insulation covering piece 44 are configured so as to cover the internal conductor barrel 24 from outside. Similarly, in the female connector Cf, the covering piece 68 of the internal conductor covering part 67 at the external conductor terminal 60 and the insulation covering piece 74 of the covering insulation part 77 arranged therein are bent inside integrally, by which the covering piece 68 and the insulation covering piece 74 are configured so as to cover the internal conductor barrel 54 from outside.

This step makes a condition where the internal conductor barrels 24 and 54 are covered by the covering insulation parts 47 and 77 of the insulation members 40 and 70 and also by the internal conductor covering parts 37 and 67 of the external conductor terminals 30 and 60, thereby providing a remarkable reduction in impedance, as compared with a case where the internal conductor barrels 24 and 54 are opened outside. Further, where the cable 10 is a shield cable, namely, a cable to which the external conductor 16 is grounded, it is also effective in improving the shield performance.

In this instance, if the bottom walls 47*a* and 77*a* of the covering insulation parts 47 and 77 and the bottom walls of 37*a* and 67*a* of the internal conductor covering parts 37 and 67 are configured so as to be recessed inwardly, as shown in the figure, the impedance will be reduced further by such a recess.

The covering insulation parts 47 and 77 which lie between the internal conductor barrels 24 and 54 and the internal conductor covering parts 37 and 67 act to prevent short-circuiting between the internal conductor terminals 20 and 50 and the external conductor terminals 30 and 60. Therefore, the covering insulation parts 37 and 67 may be crimped to the internal conductor barrels 24 and 54 in the assembly step. As shown in FIG. 4B, a clearance is provided between the barrel and the covering insulation part to form an air layer, thereby making it possible to adjust the impedance by the thickness of the air layer.

In particular, as shown in the female connector Cf, if the groove 75 is provided at an appropriate location of the covering insulation part 74 to form a part made thin for bending work, the part is firmly held, thereby making it possible to adjust the impedance more accurately.

Figure 7:
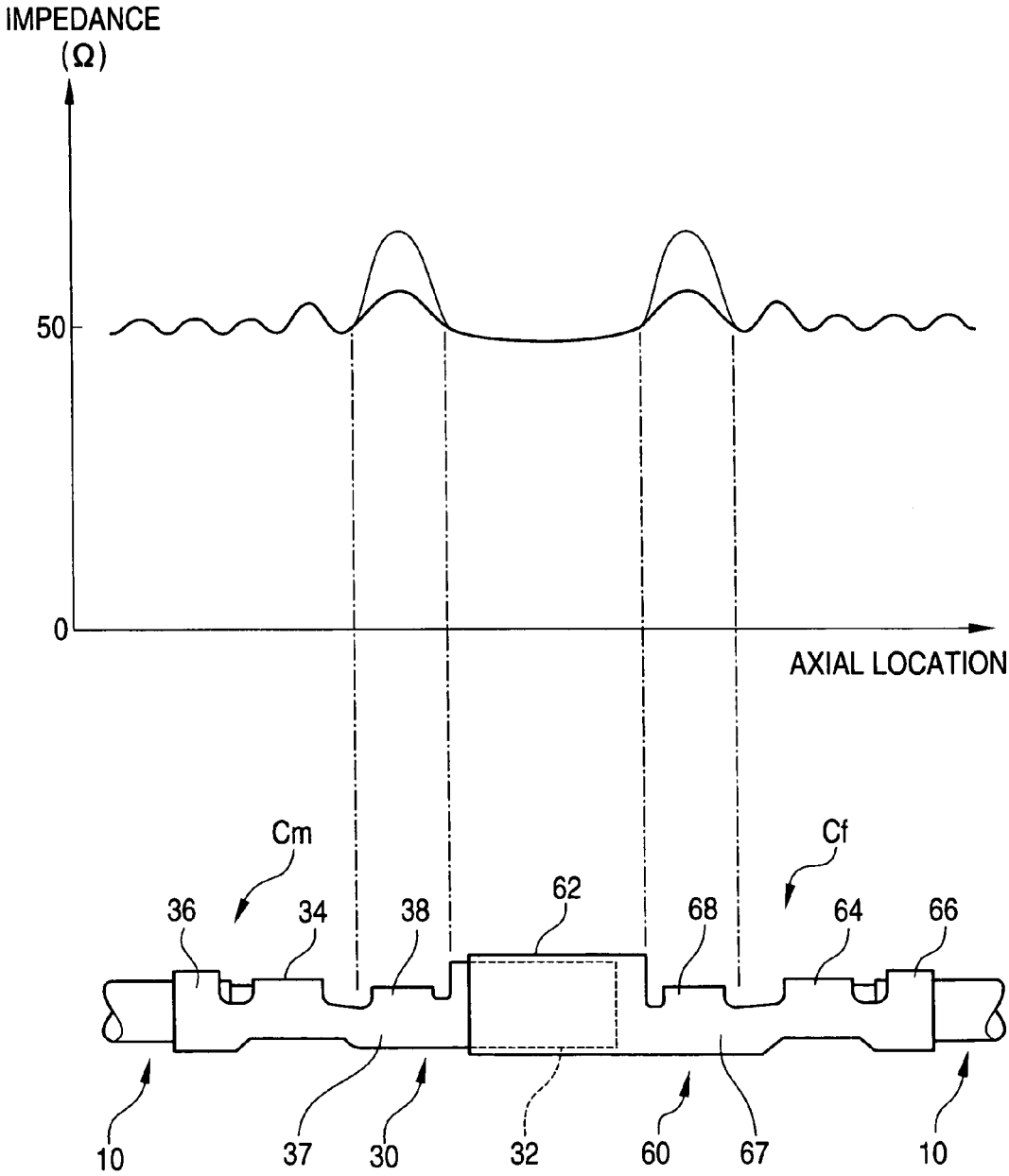
FIG. 7 is a graph showing the relationship between the axial position with the impedance in a state where the male connector is connected with the female connector.

FIG. 7 shows a relationship of the axial position with the impedance, with both the connectors Cm and Cf connected. In a conventional connector in which the internal conductor barrels 24 and 54 are opened, as shown with the two-dot dashed line in the same figure, a greatly increased impedance is locally found at a part corresponding to the internal conductor barrel, contributing to reduction in transmission efficiency. In a case of the connectors Cm and Cf, the internal conductor barrels 24 and 54 are covered by the internal conductor covering parts 37 and 67 of the external conductor terminals 30 and 60 and by the covering insulation parts 47 and 77 arranged therein, thereby making it possible to reduce the impedance effectively also at a location of the internal conductor barrel, as shown with the solid line in FIG. 7.

Further, the present invention is not restricted to the above-described embodiment, however, may be available in various embodiments.

Figure 8A:
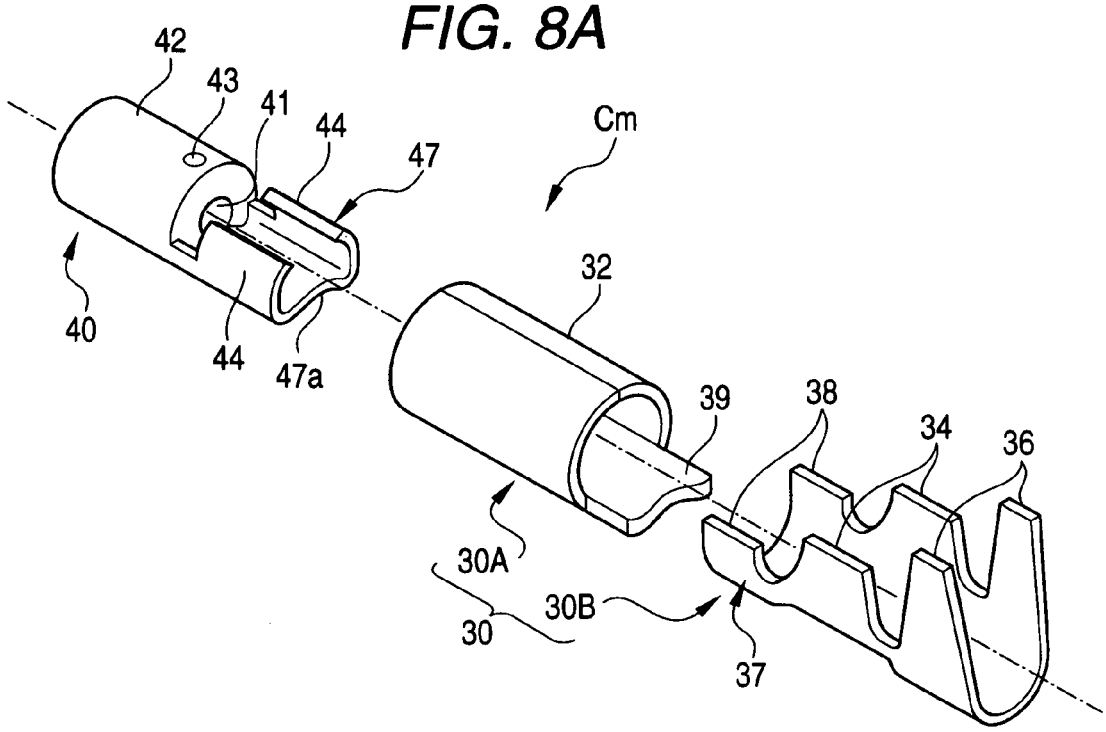
FIGS. 8A and 8B are perspective views showing an example where the external conductor terminal of the male connector is divided into an electric connection member and a crimping member.
Figure 8B:
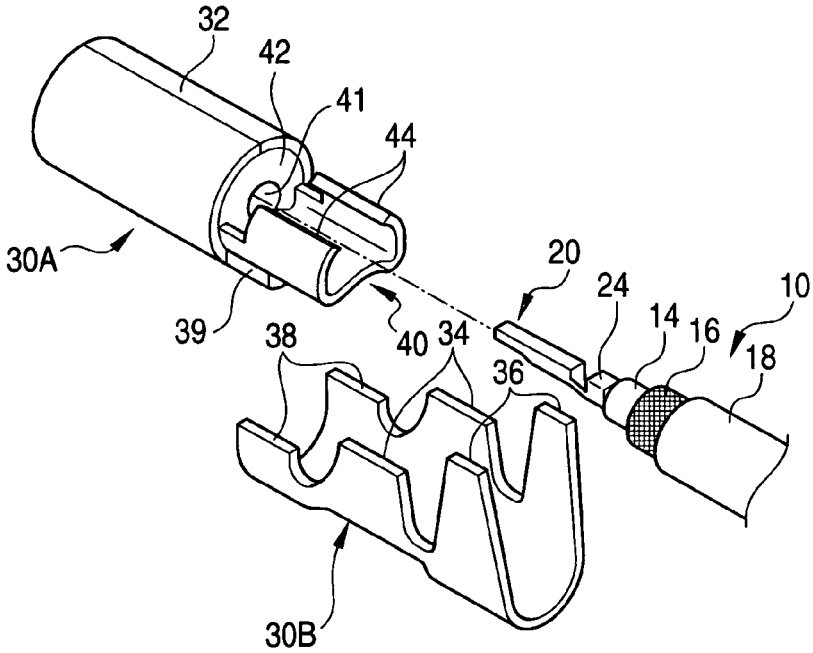
Figure 9:
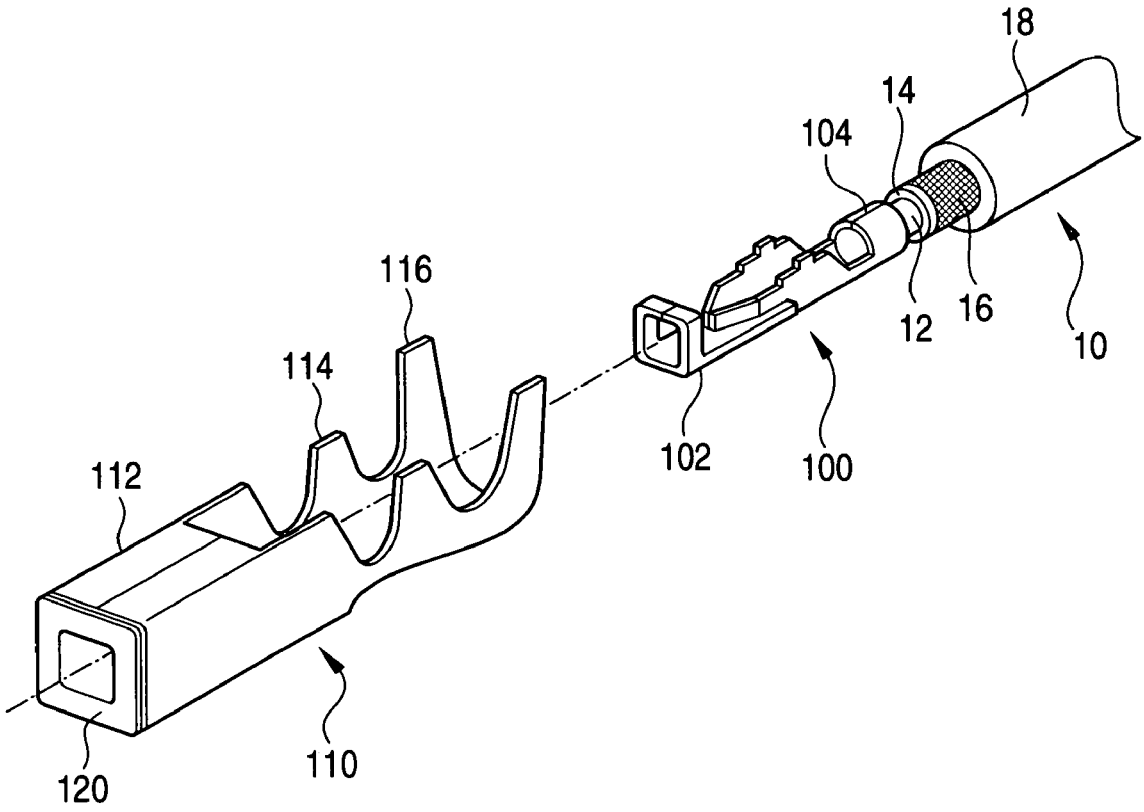
FIG. 9 is an exploded perspective view showing one example of a conventional cable connector.

FIGS. 8A, 8B show the male connector Cm, the external conductor terminal 30 of which is divided into an electric connection member 30A and a crimping member 30B. The electric connection member 30A includes the electric connection part 32, and the crimping member 30B includes the external conductor barrel 34, the insulation barrel 36 and the internal conductor covering part 37. Further, a connection piece 39 to be inserted between the covering insulation part 47 of the insulation member 40 and the internal conductor covering part 37 projects backward from the rear end of the electric connection member 30A.

According to the connector Cm, an internal conductor crimping step and an assembly step in which the terminal insulation part 42 of the insulation member 40 and the internal conductor terminal 20 are assembled to the electric connection part 32 of the electric connection member 30A are conducted, then, the external conductor barrel 34 and the insulation barrel 36 of the crimping member 30B are crimped respectively to the end of the external conductor 16 of the cable 10 and that of the sheath 18, and in a state where a connection piece 39 of the electric connection member 30A is inserted between the internal conductor covering part 37 of the crimping member 30B and the covering insulation part 47 of the insulation member 40, the internal conductor covering part 37 and the insulation covering piece 47 are bent inside integrally to give such a configuration that the covering piece 38 and the insulation covering piece 44 cover the internal conductor barrel 24 from outside, thereby making it possible to reduce the impedance at the internal conductor barrel 24 and also connect the crimping member 30B with the electric connection member 30A.

The terminal insulation part 42 of the insulation member 40 and the internal conductor terminal 20 can be assembled inside the electric connection part 32 of the electric connection member 30A more effectively by this method, without an impeditive presence of the covering piece 38 or the barrels 34 and 36.

The present invention may also be available in the following embodiments.

FIG. 1 through FIG. 7 show an embodiment of the present invention in which both the male connector Cm and the female connector Cf are used, but only either one of them may be used in the present invention.

The covering pieces 38 and 68 of the external conductor terminals 30 and 60 are not necessarily required to be formed on both the right and left sides of the internal conductor barrels 22 and 52, and a single covering piece erecting from one of the terminal walls may be bent, for example, up to the other terminal wall.

In the embodiment shown in FIGS. 6A and 6B, the groove 75 is provided on the inner plane of the covering insulation part 77 to form a part made locally thin for bending work. A similar groove or notch may be provided on the outer circumferential plane or both on the outer and inner circumferential planes.

It is also possible to reduce the impedance at the internal conductor barrels 24 and 54 even when the insulation members 40 and 70 and the covering insulation parts 47 and 77 of the terminal insulation parts 42 and 72 are respectively formed as individual members such as terminal insulation member and covering insulation member.

What is claimed is:

1. A connector which is loaded to the end of a cable including an internal conductor and an external conductor arranged radially outside of the internal conductor via an insulation layer therebetween, the connector comprising:

the internal conductor terminal having:

an electric connection part contacting with an opposing terminal; and an internal conductor crimping part being arranged behind the electric connection part, and the internal conductor crimping part being crimped to an end of the internal conductor;

the external conductor terminal having:

an electric connection part having a shape to cover the electric connection part of the internal conductor terminal outside in a radial direction thereof, and the electric connection part of the external conductor terminal contacting with the opposing terminal; and an external conductor crimping part being arranged behind the electric connection part of the external conductor terminal, and the external conductor crimping part being crimped to an end of the external conductor;

a terminal insulation member being formed by an electric insulator and being radially disposed between the electric connection part of the internal conductor terminal and the electric connection part of the external conductor terminal, an internal conductor covering part having a covering piece capable of being bent inside, the covering piece being longitudinally arranged between the electric connection part of the external conductor terminal and the external conductor crimping part, and a covering insulation member being formed by an electric insulator and covering an inner side surface of the internal conductor covering part, wherein the internal conductor covering part is partially covered from outside by integrally bending the covering piece of the internal conductor covering part and the covering insulation member inside.

2. A connector according to claim 1, wherein the covering piece of the internal conductor covering part is formed on right and left sides of the internal conductor crimping part.

3. A connector according to claim 2, wherein a connection part connecting the right and left covering pieces and a part of the covering insulation member corresponding to the connection part are formed to be inwardly recessed.

4. A connector according to claim 1, wherein the covering insulation member has a thin bent part which is partially thin for bending.

5. A connector according to claim 1, further comprising:

an insulating member being configured such that a terminal insulation part being disposed between the electric connection part of the internal conductor terminal and the electric connection part of the external conductor terminal and an covering insulation part covering the inner side surface of the internal conductor covering part are integrally formed, wherein the insulating member serves as the terminal insulation member and the covering insulation member.

6. A connector according to claim 3, further comprising:

an insulating member being configured such that a terminal insulation part being disposed between the electric connection part of the internal conductor terminal and the electric connection part of the external conductor terminal and an covering insulation part covering the inner side surface of the internal conductor covering part are integrally formed, wherein the insulating member serves as the terminal insulation member and the covering insulation member, wherein the insulating member includes:

a recessed part being configured such that a part corresponding to the connection part is inwardly recessed; and a step part formed between the recessed part and a part anterior to the recessed part, and wherein the recessed part of the insulating member contacts with the step part from therebehind so as to retain the insulating member with respect to the external conductor terminal.

7. A connector according to claim 5, wherein the external conductor terminal is divided into an electric connection member having the electric connection part and a crimping member having the covering piece of the internal conductor covering part and the external conductor crimping part, and wherein the electric connection member is provided with a connection part which connects the external conductor terminal with the electric connection member by being inserted between the covering insulation part of the insulation member and the internal conductor covering part.

8. A cable, comprising:

a connector which is loaded to the end of the cable including an internal conductor and an external conductor arranged radially outside of the internal conductor via an insulation layer therebetween, the connector comprising:

the internal conductor terminal having:

an electric connection part contacting with an opposing terminal; and an internal conductor crimping part being arranged behind the electric connection part, and the internal conductor crimping part being crimped to an end of the internal conductor;

the external conductor terminal having:

an electric connection part having a shape to cover the electric connection part of the internal conductor terminal outside in a radial direction thereof, and the electric connection part of the external conductor terminal contacting with the opposing terminal; and an external conductor crimping part being arranged behind the electric connection part of the external conductor terminal, and the external conductor crimping part being crimped to an end of the external conductor;

a terminal insulation member being formed by an electric insulator and being disposed between the electric connection part of the internal conductor terminal and the electric connection part of the external conductor terminal, an internal conductor covering part having a covering piece capable of being bent inside, the covering piece being formed between the electric connection part of the external conductor terminal and the external conductor crimping part, a covering insulation member being formed by an electric insulator and covering an inner side surface of the internal conductor covering part, wherein the internal conductor covering part is partially covered from outside by integrally bending the covering piece of the internal conductor covering part and the covering insulation member inside, and the cable having;

an internal conductor crimped to an internal conductor crimping part of the connector;

an insulation layer;

an external conductor being arranged radially outside of the internal conductor via the insulation layer therebetween and being crimped to an external conductor crimping part of the connector, wherein the covering piece and an insulating member disposed inside the covering piece are integrally bent inside to cover the internal conductor crimping part of the connector from outside.

9. A cable with a connector according to claim 8, wherein an air layer is formed between the covering insulation member and the internal conductor crimping part of the cable.

10. A cable with a connector according to claim 8; wherein the cable is a shield cable, in which the outer conductor thereof is grounded.

11. A method for manufacturing a cable with a connector, comprising:

crimping the internal conductor crimping part according to claim 1 to an end of the internal conductor of a cable including an internal conductor and an external conductor arranged radially outside of the internal conductor via an insulation layer therebetween;

assembling the connector;

crimping an external conductor crimping part of an external conductor terminal of the connector to the end of the external conductor of the cable; and bending the covering piece of the external conductor terminal and the covering insulation member arranged therein inside together covering the internal conductor crimping part from the outside by the covering piece and the covering insulation member.

12. A method for manufacturing a cable with a connector, comprising:

crimping the internal conductor crimping part according to claim 7 to an end of the internal conductor of a cable including an internal conductor and an external conductor arranged radially outside of the internal conductor via an insulation layer therebetween;

assembling the connector;

crimping an external conductor crimping part of an external conductor terminal of the connector to the end of the external conductor of the cable; and bending the covering piece of the external conductor terminal and the covering insulation member arranged therein inside together covering the internal conductor crimping part from the outside by the covering piece and the covering insulation member, thereby to connect the crimping member to the electric connection member.

* * * * *